US007617998B2

(12) United States Patent
Mauchle et al.

(10) Patent No.: US 7,617,998 B2
(45) Date of Patent: Nov. 17, 2009

(54) POWER SPRAY-COATING GUN AND GUN-HOUSING

(75) Inventors: Felix Mauchle, Abtwil (CH); Hanspeter Michael, Gossau (CH); Marco Sanwald, St. Gallen (CH)

(73) Assignee: ITW Gema GmbH, St. Gallen (CH)

( * ) Notice: Subject to any disclaimer, the term of this patent is extended or adjusted under 35 U.S.C. 154(b) by 0 days.

(21) Appl. No.: 11/911,137

(22) PCT Filed: Apr. 17, 2006

(86) PCT No.: PCT/IB2006/000881

§ 371 (c)(1),
(2), (4) Date: Oct. 10, 2007

(87) PCT Pub. No.: WO2006/111811

PCT Pub. Date: Oct. 26, 2006

(65) Prior Publication Data

US 2008/0191067 A1 Aug. 14, 2008

(30) Foreign Application Priority Data

Apr. 18, 2005 (DE) ..... 10 2005 017 931

(51) Int. Cl.
*B05B 9/01* (2006.01)
*B05B 5/00* (2006.01)
*B05C 5/02* (2006.01)

(52) U.S. Cl. ..... 239/707; 239/526; 239/690; 239/706; 118/629

(58) Field of Classification Search ..... 239/526, 239/690, 706–708; 118/621, 629
See application file for complete search history.

(56) References Cited

U.S. PATENT DOCUMENTS

| | | | | |
|---|---|---|---|---|
| 3,608,823 | A | 9/1971 | Buschor | |
| 3,938,740 | A * | 2/1976 | Bertilsson et al. | 239/707 |
| 4,311,113 | A | 1/1982 | Jordan et al. | |
| 4,798,340 | A * | 1/1989 | Vohringer et al. | 239/692 |
| 4,993,645 | A | 2/1991 | Buschor et al. | |
| 5,022,590 | A * | 6/1991 | Buschor | 239/708 |
| 5,678,770 | A * | 10/1997 | Shah | 239/690 |
| 6,562,138 | B1 * | 5/2003 | Haas | 118/625 |
| 6,622,948 | B1 | 9/2003 | Haas et al. | |
| 2003/0141393 | A1 * | 7/2003 | Keudell et al. | 239/690 |

OTHER PUBLICATIONS

International Search Report mailed Aug. 23, 2006 for PCT/IB2006/000881.

* cited by examiner

*Primary Examiner*—Darren W Gorman
(74) *Attorney, Agent, or Firm*—Lowe Hauptman Ham & Berner LLP

(57) ABSTRACT

A powder spraycoating gun and its gun housing. The spraygun housing is a plastic, integral body constituting a stock fitted with a powder discharge tube and a grip fitted with a powder intake tube.

15 Claims, 3 Drawing Sheets

POWER SPRAY-COATING GUN AND GUN-HOUSING

The present invention relates to a plastic spraygun housing for a powder spraycoating gun defined in claim 1.

Moreover the invention relates to a powder spraycoating gun fitted with such a plastic housing.

U.S. Pat. No. 3,608,823 discloses a powder spray gun to electrostatically spraycoat objects with coating powder. This gun comprises several high voltage electrodes to electrostatically charge the coating powder. A hose constitutes a powder duct running through the powder spraycoating gun. In one embodiment mode, said hose only runs through the gun stock and can be connected at the rear stock end to a powder feed hose. In another embodiment, the powder hose runs both through the stock and a gun grip.

U.S. Pat. No. 4,993,645 shows a gun with an angled powder duct of which one leg can be plugged into a gun stock and the other leg into a gun grip.

The objective of the present invention is to design the powder spraycoating gun in a manner it contains fewer interfaces presenting a danger of electric arcing and powder accumulation.

Furthermore the powder spraycoating gun of the present invention shall be light-weight and economical in manufacture.

These goals are attained by the features of the independent claims of the present invention.

Further advantageous features of the present invention are defined in the dependent claims.

The present invention is elucidated below in relation to the appended drawings of preferred, illustrative embodiments.

Figure 1:
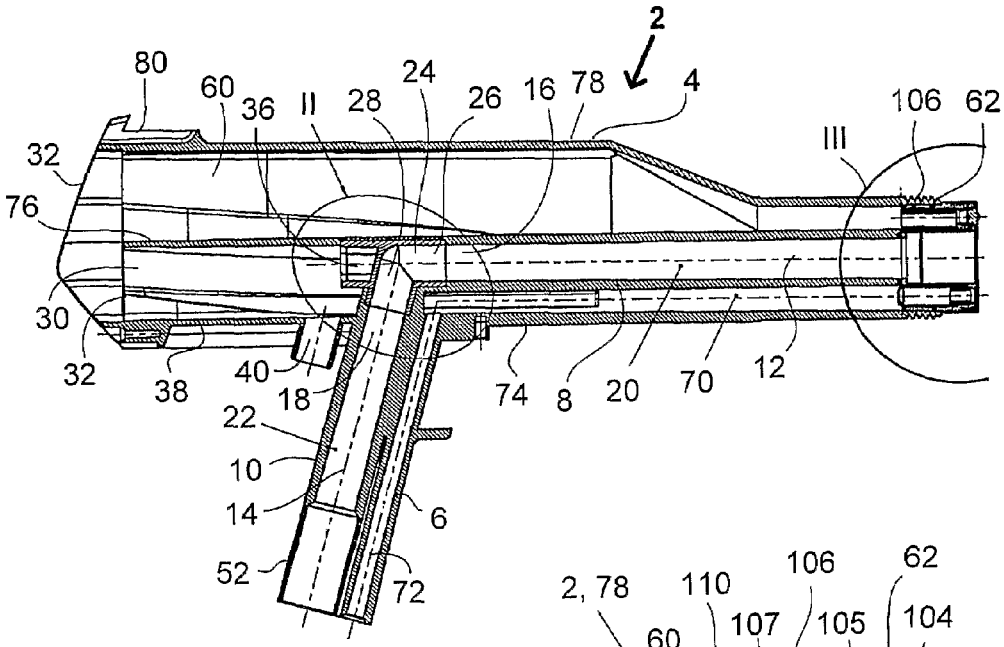
Figure 3:
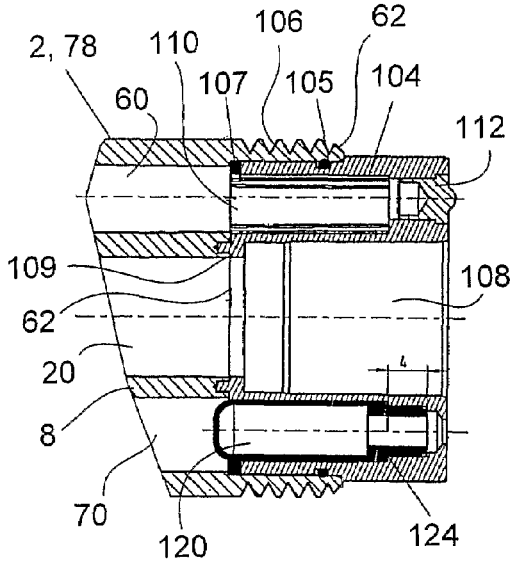
Figure 2:
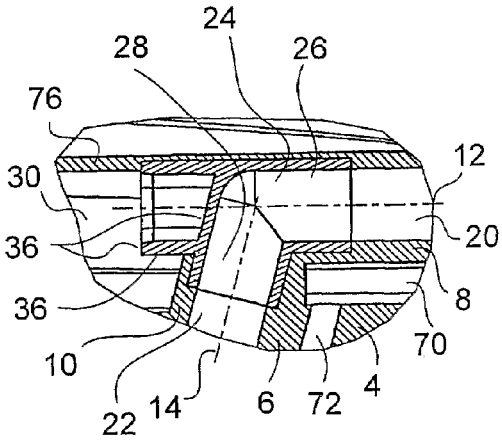
Figure 4:
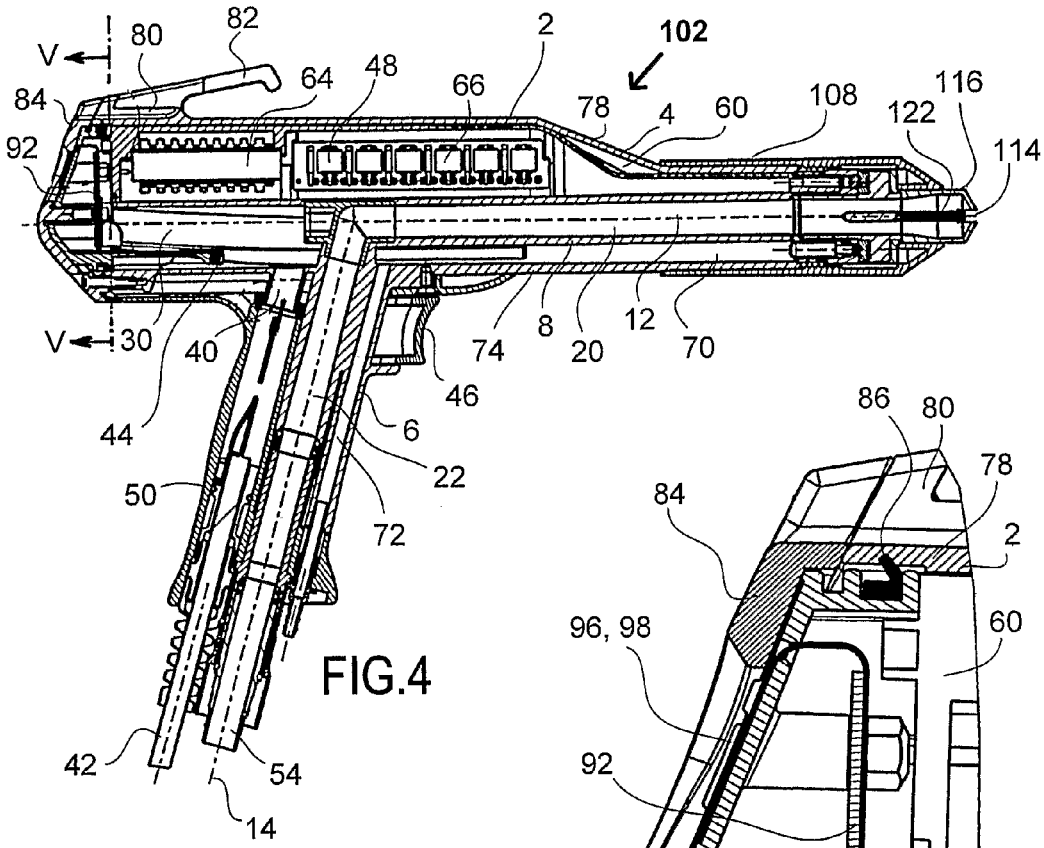

FIG. 1 is an axial section of a gun housing for a powder spraycoating gun of the invention, FIG. 2 is a cutaway II relating to FIG. 1 enlarged to twice the size, FIG. 3 is a cutaway III of FIG. 1 relative to FIG. 3 in triple size, FIG. 4 is a longitudinal section of a powder spraycoating gun of the invention showing a gun housing of FIGS. 1, 2 and 3.

Figure 5:
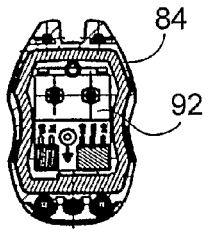
Figure 6:
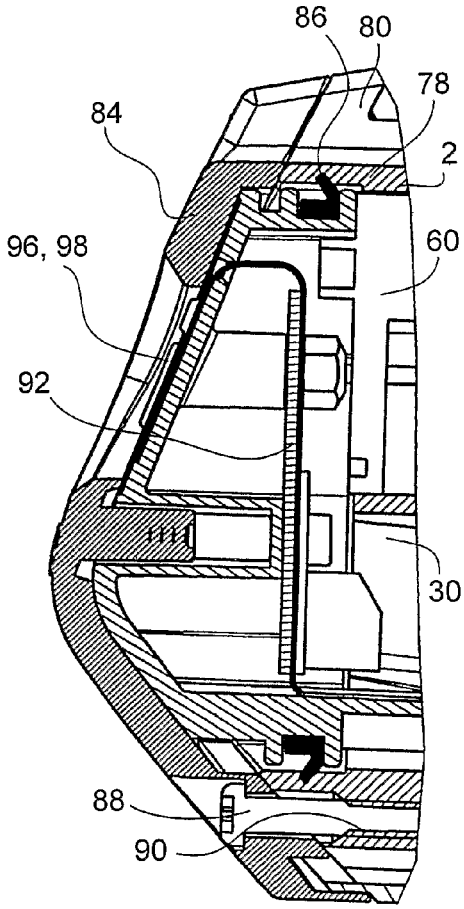
Figure 8:
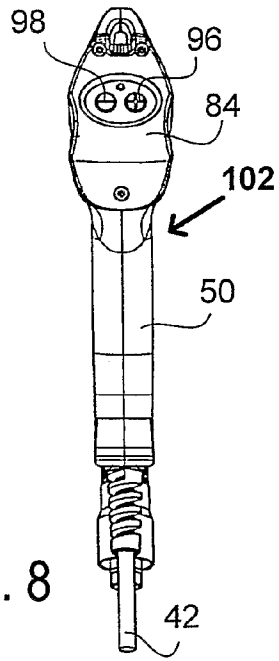
Figure 7:
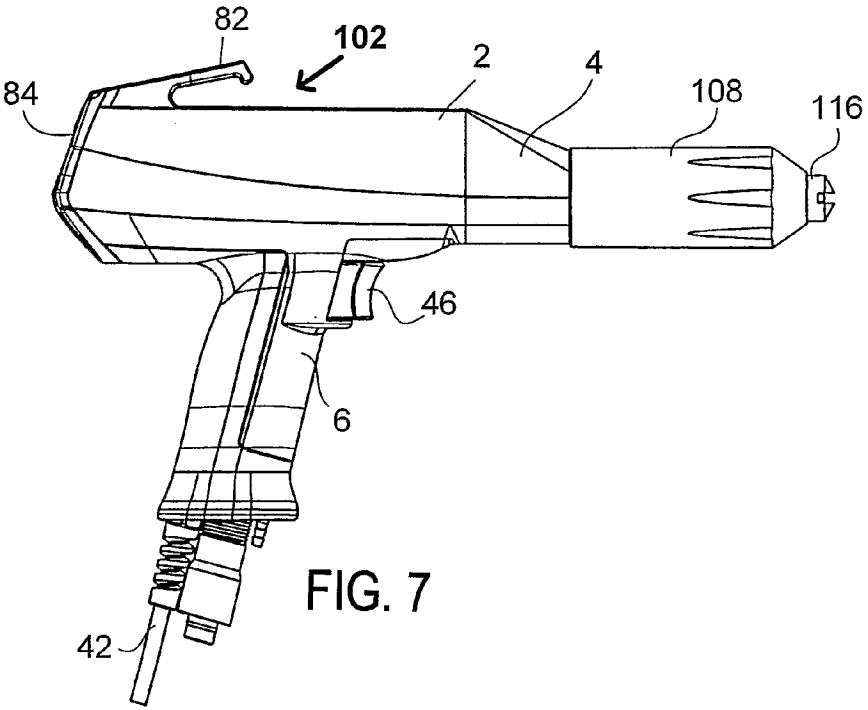
Figure 9:
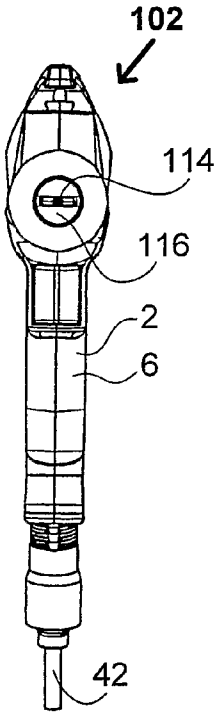
Figure 10:
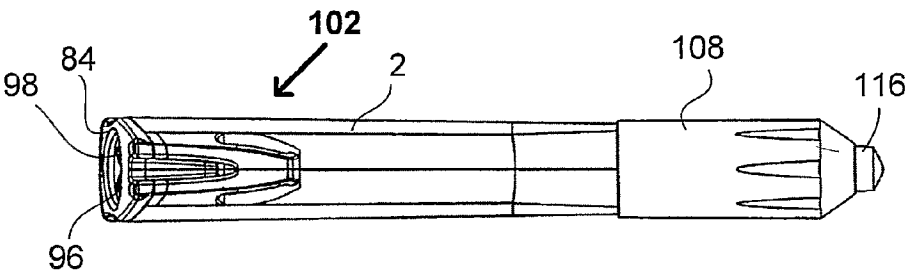

FIG. 5 is a longitudinal view of a powder spraycoating gun of the invention fitted with a gun housing as shown in the plane V-V of FIG. 4, FIG. 6 is the same sealing element as shown in longitudinal section in FIG. 4 but on a substantially enlarged scale, FIG. 7 is a sideview of the powder spraycoating gun of the invention, FIG. 8 is a rear view of the powder spraycoating gun of FIG. 7, FIG. 9 is a front view of the powder spraycoating gun of FIG. 7, and FIG. 10 is a topview of the powder spraycoating gun of FIG. 7.

The spraygun housing 2 shown in FIG. 1 is made of plastic and constitutes the basic casing of the a powder spraycoating gun. The gun housing 2 is a casing made integrally by injection molding or mold casting methods or similar plastic molding procedures, said casing comprising at least a stock 4 and a grip 6 which runs obliquely downward from the stock 4. The stock 4 subtends a discharge powder duct 8 running straight in its longitudinal direction 4. The grip 6 subtends a straight intake powder duct 10 running in the longitudinal grip direction. The axial center lines 12 and 14 of the two powder ducts 8 and 10 are situated in a common plane which in FIG. 1 is the plane of the drawing, and accordingly said two center lines do intersect. The mutually adjacent ends 16 and 18 respectively of the tubular ducts 20 and 22 of the two powder ducts 8 and 10 communicate with each other.

The two powder ducts 8 and 10 and the gun housing 2 altogether form one component.

The mutually adjacent ends 16 and 18 of the tubular ducts 20 and 22 may communicate with each other in a manner that the two powder tubes 8 and 10 continuously merge into each other in the form of an integral component.

In the preferred embodiment mode of the invention shown in FIG. 1, the mutually adjacent ends 16 and 18 of the tubular ducts 20 and 22 communicate with each other by means of an angled tube stub 24 made of an electrically insulating material which is coated by injection molding or cast molding with the plastic of the integral gun housing 2 when same is being manufactured and as a result is enclosed in said plastic. Preferably the angled tube stub 24 is made of a material more abrasion-resistant than the plastic integral gun housing 2, in order to be more abrasion-resistant to the coating powder flow moved pneumatically by an airflow through the powder tubes 8 and 10. The angled tube stub 24 therefore preferably is made of a plastic other than that of the gun housing 2 or of a ceramic or hard glass or another abrasion-resistant material. The material of the angled tube stub 24 should be selected for abrasion resistance and so that powder depositions should be precluded on said stub.

However the angled tube stub 24 also may be used for other purposes, namely to support injection mold cores and/or to subtend separate spaces in the gun housing 2 during latter's manufacture. When the angled tub stub serves only the latter purposes, it may be made of the same plastic as the gun housing 2, or of a different one. Preferably though the material of the angled tube stub 24 shall be more abrasion-resistant than the plastic of the bun housing 2 in order to attain both advantages, namely on one hand lesser wear due to powder friction and lesser danger the powder will adhere/deposit in the transition range between the two powder tubes 8 and 10, and on the other hand easing the manufacture of the gun housing 2 when using injection molding or another plastic shaping procedure.

The angled tube stub 24 comprises a discharge tube leg 26 which extends axially into the discharge powder tube 8 of the stock 4 and which is substantially shorter than the segment of the discharge tube duct 20 axially adjoining it. The angled tube stub 24 furthermore comprises an intake tube leg 28 axially extending into the intake tube element 10 of the grip 6.

In one embodiment mode, the intake tube leg 28 may run over the full length of the grip 6 but according to the preferred embodiment shown in FIG. 1, its length is substantially shorter than the grip 6 and preferably also substantially shorter than the segment of the intake tube duct 22 adjoining the intake tube leg 28.

The angled tube duct constituted by the angled tube stub 24 preferably is aligned in the longitudinal duct direction with the discharge tube duct 20 respectively with the intake tube duct 22 in order to preclude protrusions or edges at the transition sites from aggregating coating powder.

A rear housing chamber 30 is subtended in the gun housing 2 and extends from the angled tube stub 24 to the rear and issues into the open at the rear housing end 32. The angled tube stub 24 comprises at its back side away from the discharge tube leg 26 a lateral back zone 36 which is freely exposed in the rear housing chamber 30 without being covered by the plastic of the gun housing 2. When manufacturing the gun housing by injection molding or in another casting procedure, the angled tube stub 24 may keep apart mold cores that can be put in position from three sides, namely from the rear in order to form the lower rear chamber 30, from the front in order to form the discharge tube duct 20 and from below in order to form the intake tube duct 22. In this procedure the tube stub 24 is kept in the desired position by means of the mold cores.

In another embodiment mode of the invention, all external surfaces, including the rear side zone 36, of the angled tube stub 24 are injection-coated with the plastic from the gun housing 2. In this manner the powder duct subtended by the tube ducts 20 and 22 and the angled tube stub 24 is electrically insulated even more for the purpose of avoiding high voltage arcing toward lower potentials, for instance ground. This feature is especially significant when the coating powder contains electrically conducting particles.

In the shown embodiment mode of FIG. 1, the angled tube stub 24 is enclosed by the plastic of the gun housing 2 on its left side, on its right side, on its angle inside and on its angle top side, the tube legs 26 and 28 entering offset end zones of the tubular ducts 20 respectively 22. Only said back side zone 36 of the angled tube stub 24 is not covered by the plastic from the gun housing 2.

In the preferred embodiment of FIG. 1, the back side zone 36 of the angle tube stub 24 assumes the shape of a tube muff configured axially with the discharge tube leg 26 but in opposite direction.

A feedthrough aperture 40 to pass at least one electric line, preferably a cable 42 shown in FIG. 4, is configured in the lower wall 38 of the lower, rear housing chamber 30.

In another but omitted embodiment mode, the cable 42 runs only as far as the grip 6 where it is connected to electric terminals of conductors going to the reed switch 44.

The grip 6 subtends all or most of the grip front side. A rear grip shell 50 is mounted on the back side of the grip 6 and passes the cable 42 in the manner shown in FIG. 4. The intake powder tube 10 of the grip 6 is designed as a plug-in element at its lower end zone 52 to connect to a powder hose 54, as indicated in FIGS. 1 and 4. The trigger 46 driving the reed switch 44 is situated at the front side in the upper grip end zone. The grip 6 runs from the lower end of the stock 4 downward preferably by at least 4 cm.

As shown in FIGS. 1 and 4, an upper housing chamber 60 runs from the rear housing end 32 to the front housing end 62, said chamber 60 being open at least at the rear housing end 32 to allow inserting the high voltage generator 48.

The high voltage generator 48 shown in FIG. 4 comprises at least one transformer 64 and a cascade circuit 66 based on a principle of the state of the art.

The gun housing 2 preferably also contains at least one compressed air duct 70, 72 running parallel to the tube duct 20 of the discharge powder tube 8 through the stock 4 as far as the front housing end 62. In the embodiment mode of FIG. 1 the compressed air duct 70, 72 consists of a compressed-air discharge duct 70 constituted by the grip 4 and extending from the upper end of the grip 6 as far as the front housing end 62 parallel to the powder discharge tube 8, and of a compressed-air intake duct 72 which extends parallel to the powder intake tube 10 from the lower end to the upper end of and through the grip 6 and issues into the rear end of the compressed-air discharge duct 70.

In another but omitted embodiment mode, the compressed air duct 70, 72 also may consist only of the compressed-air discharge duct 70, in which case the end of said compressed air duct facing the grip 6 is fitted with an omitted compressed-air intake aperture constituted in a lower housing wall 74 and running from the grip 6 as far as the front housing end 62.

The front housing end 62 is open in the zone of the powder discharge duct 20, in the zone of the compressed air duct 70, 72 and preferably also in the zone of the upper housing chamber 60.

The upper housing chamber 60 runs rearward beyond the angled tube stub 24 and also beyond the lower rear housing chamber 30.

The discharge tube duct 20 is separated by the powder discharge tube 8 from the compressed air discharge duct 70 and from the upper housing chamber 60. A rearward extension of the upper region of the powder discharge tube 8 is designed to be a partition 76 between the upper housing chamber 60 and the rear housing chamber 32. Absent this partition 76, the rear, lower housing chamber 30 no longer would be separated from the rear segment of the upper housing chamber 60, such a design however also being an applicable embodiment of the invention.

An upper housing wall 78 constitutes the cover wall of the upper housing chamber 60 and runs from the rear housing end 32 to the front housing end 62. This upper housing wall 78 is fitted at its rear end preferably with an adapter 80 to receive and affix a hook 82 with which to hang up the gun housing or the related powder spraycoating gun when not in use. The adapter 80 is integral with the gun housing 2. In another embodiment mode, the hook 82 also may be integral with the gun housing 2.

The invention also relates to a powder spraycoating gun 102 comprising a gun housing endowed with at least one or preferably several of the above described features of the gun housing 2.

Such a powder spraycoating gun 102 is shown in FIGS. 4 through 10. Some features also are shown in FIGS. 1 and 3. Accordingly the housing end 32 comprises two housing chambers 30 and 60 which are open to the rear, or a single one open to the rear that is, in the already described manner, a combination of the lower, rear housing chamber 30 and the rear segment of the upper housing chamber 60. This rearwardly open housing end 32 is closed in the invention by a closing body 84 that is inserted into the rear housing end 32 and that is radially sealed relative to the inside surfaces of the outer housing walls, as shown in particular detail in FIG. 6. Illustratively at least one radial seal 86 may be used for said radial sealing feature. The closing body 84 is detachably attached to the gun housing 2, for instance by one or more screws 88. For that purpose the end face at the rear end 32 of the gun housing 2 may be fitted with one or more threaded boreholes 90.

In a preferred embodiment of the invention, the closing body 84 comprises an electric circuit 92 at its inside, said circuit also including the reed switch 44. Moreover the closing body 84 preferably comprises manually operated actuating elements used to adjust the rate (quantity per unit time) of powder to be sprayed, for instance a pushbutton 96 to raise power discharge and a pushbutton 98 to reduce it. The two pushbuttons 96 and 98 are configured on the rear side of the closing body 84 and are shown in FIG. 8. The actuation elements 96, 98 are preferably pressure keys. They also may be capacitive or inductive touch sensors. Still other actuation elements may be used to adjust the voltage of the high voltage generator 48.

In a special embodiment of the invention, the powder is fed through the powder hose 54 (FIG. 4) to the powder spraycoating gun 102 as a function of one or more coating programs within an electronic control unit that is situated apart from the powder spraycoating gun 102. Said control unit preferably shall also allow adjusting the output voltage of the high voltage generator 48. In a particular embodiment of the invention, the electric circuit 92 of the powder spraycoating gun may be designed in a manner to be selected from a group of programs by using certain actuation elements. In a particular embodiment of the invention, by simultaneously actuating the two actuation elements 96 and 98, operation shall be switched to another coating program stored in the omitted control unit.

By plugging the closing body 84 into the gun housing 2 and by using radial sealing instead of axial sealing, or radial sealing in addition to axial sealing, as indicated schematically by the radial seal 86 in FIG. 6, the rear ends of the housing chambers 30 and 60 shall be better sealed than by an axial seal between the end faces of the gun housing 2 and of the closing body 84. Such radial sealing is unaffected by the manufacturing tolerances of the individual elements/components.

Another special feature of the powder spraycoating gun 102 is an electrically insulating spacer 104 axially inserted at the front housing end 62 of the gun housing 2.

The spacer 104 is sealed off preferably by at least one sealing ring 105 configured radially between the spacer 104 and the outer peripheral wall of the gun housing 2. Moreover a sealing ring 107 may be mounted between the spacer 104 and the gun housing.

In a special feature of the invention, the spacer 104 is welded ultrasonically to the gun housing 2, preferably at least to the downstream end of the powder discharge tube 8. FIG. 3 shows such an ultrasonic weld 109.

Adhesive bonds also may be used instead of ultrasonic welds and/or seals.

The powder outlet tube 8 is slightly shorter than the lower housing wall 74, than the upper housing wall 78 and than the sidewalls connecting said lower and upper walls, which altogether preferably are circularly round and preferably are fitted at their outer circumference with an external thread 106 to be screwed into a threaded bush 108, as shown in FIGS. 3 and 4.

The spacer 104 contains a central connecting duct 108 which axially adjoins the front end of the powder outlet duct 20 of the powder discharge tube 8 and an upper connecting duct 110 which axially adjoins the front end 62 of the upper housing chamber 60. The front end of the upper connecting duct 110 is closed by an electric contact 112 which, at its front end face, outside the upper connecting duct 110, can make conducting contact with another (omitted) electrical terminal that is connected or at least connectable to an electric high-voltage electrode 114 fitted on a spray unit 116 to spray coating powder.

The spray unit 116 is affixed by means of the threaded bush 108 to the front end of the gun housing 2, and, as shown illustratively in FIG. 4, being clamped against the end face of the spacer 104. The spacer 104 is situated between the gun housing 2 and the spray unit 116. The spacer 104 preferably contains a lower connecting duct 120 which axially adjoins the front end of the compressed-air discharge duct 70 feeding compressed air through an electrically insulating tube 122 received in the spray unit 116 and containing the electrode 114. In another embodiment mode the tube 122 per se may be such an electrode. The compressed air is used to flush coating powder off the high voltage electrode 116 to preclude coating powder aggregation/adhesion. The spacer 104 moves the electric contact 112 away from the gun housing 2. In this manner the danger of damage/destruction by corona discharges to the gun housing plastic is reduced or averted, which otherwise might arise from a poor connection between a high voltage terminal of the high voltage generator 48 and the contact 112.

A filter 124 filtering the compressed air is preferably used in the connecting duct 120.

The invention claimed is:

1. A spraygun housing for a powder spraycoating gun, wherein the spraygun housing comprises:

an integral, plastic structure comprising:

a stock;

an integral grip extending downward from the stock;

wherein:

the stock has an integral powder discharge tube extending longitudinally along the stock for guiding powder to be sprayed by a spraygun of which the spraygun housing forms a part;

the grip has an integral powder intake tube extending through the grip and configured to guide the powder;

the axial center lines of the two powder tubes are configured in a common plane, wherein the two powder tubes intersect;

wherein mutually adjacent ends of the tube ducts are connected to each other by an electrically insulating angled tube stub which is enclosed by the integral plastic structure; wherein the angled tube stub comprises a tube discharge leg axially entering the powder discharge tube of the stock said leg being substantially shorter than a powder-guiding segment of the powder discharge tube adjoining said leg; and wherein the angled tube stub comprises a tube intake leg axially entering the powder intake tube of the grip.

2. Spraygun housing as claimed in claim 1, wherein the tube intake leg of the angled tube stub entering the powder intake tube of the grip, is substantially shorter than the powder-guiding segment of the powder intake tube adjoining the tube intake leg.

3. Spraygun housing as claimed in claim 1, wherein a lower, rear housing chamber is subtended in the gun housing and runs rearward from the angled tube stub and issues freely at the rear housing end.

4. Spraygun housing as claimed in claim 3, wherein the angled tube stub comprises at a rear side away from the tube discharge leg a rear side zone which is situated in free manner in the lower, rear housing chamber without being enclosed by injected gun housing plastic.

5. Spraygun housing as claimed in claim 3, wherein all external surfaces of the angled tube stub are enclosed by injected gun housing plastic.

6. Spraygun housing as claimed in claim 3, wherein a connecting aperture is configured in a lower wall of the lower, rear housing chamber for the purpose of passing at least one electrical line.

7. Spraygun housing as claimed in claim 1, wherein the angled tube stub is made of a material more abrasion resistant than the plastic of the gun housing and in that it counteracts coating powder deposits.

8. Spraygun housing as claimed in claim 1, wherein, starting from the stock, the grip extends at least 4 cm downward.

9. Spraygun housing as claimed in claim 1, wherein the spraygun housing constitutes an upper housing chamber extending from the rear housing end to the front housing end and being open at the rear housing end to allow inserting a high voltage generator.

10. Spraygun housing as claimed in claim 1, wherein the spraygun housing constitutes at least one compressed air duct which comprises a segment extending through the stock parallel to the tube duct of the powder discharge tube as far as the front housing end.

11. Spraygun housing as claimed in claim 1, wherein the compressed air duct comprises a segment also extends through the grip parallel to the tube duct of the powder intake tube.

12. Spraygun housing as claimed in claim 9, wherein the rear housing end constitutes at least one housing chamber which is open to the rear and is closed by a closing body that closes minimum of one housing chamber at the rear end and that is inserted into the rear housing end, that is sealed off radially relative to the inner housing walls and is detachably affixed to the gun housing.

13. Spraygun housing as claimed in claim 9, wherein an electrically insulating spacer is inserted at a front housing end into the front housing end of the gun housing, said spacer being fitted with a central connecting duct axially adjoining an end of a powder discharge duct and with an upper connecting duct axially adjoining the upper housing chamber; where a front end of the upper connecting duct is sealed by an electric terminal which, within the upper connecting duct, can be contacted by a high voltage terminal of the high voltage generator and which, on a front side situated in front and outside the upper connecting duct can be contacted by a further electrical terminal that is connected to at least one electric high voltage electrode fitted on a spray unit, said spray unit in turn being affixed to the front end of the gun housing, said spacer being situated between the gun housing and the spray unit.

14. Spraygun housing as claimed in claim 13, characterized in that the spacer is ultrasonically welded to the gun housing.

15. Spraygun housing as claimed in claim 14, characterized in that the spacer is ultrasonically welded to the powder discharge tube of the gun housing.

* * * * *